United States Patent [19]

Nagasaki

[11] Patent Number: 4,940,652

[45] Date of Patent: Jul. 10, 1990

[54] METHOD OF PROCESSING SILVER HALIDE PHOTOGRAPHIC MATERIAL WHICH PREVENTS SEPIA DETERIORATION

[75] Inventor: Satoru Nagasaki, Hino, Japan

[73] Assignee: Konica Corporation, Tokyo, Japan

[21] Appl. No.: 309,511

[22] Filed: Feb. 10, 1989

[30] Foreign Application Priority Data

Feb. 20, 1988 [JP] Japan ..... 63-3772119

[51] Int. Cl.[5] ..... G03C 5/24

[52] U.S. Cl. ..... 430/403; 430/429; 430/510; 430/517; 430/944; 430/963; 430/966

[58] Field of Search ..... 430/403, 429, 510, 517, 430/944, 963, 966

[56] References Cited

U.S. PATENT DOCUMENTS

| | | | |
|---|---|---|---|
| 3,647,460 | 3/1972 | Hofman et al. | 430/963 |
| 4,564,588 | 1/1986 | Sakamoto et al. | 430/509 |
| 4,639,417 | 1/1987 | Honda et al. | 430/567 |
| 4,818,675 | 4/1989 | Miyasaka et al. | 430/567 |

*Primary Examiner*—Paul R. Michl
*Assistant Examiner*—Janet C. Baxter
*Attorney, Agent, or Firm*—Finnegan, Henderson, Farabow, Garrett, and Dunner

[57] ABSTRACT

A method of processing a silver halide photographic material of total silver amount of no more than 7.0 g/m$^2$ on a support containing at least one of a dye having a maximum absorption wavelength between 520–560 nm and a dye having a maximum absorption wavelength between 570–700 nm in such an amount that the increase of transmission optical density of the unexposed area after processing is no more than 0.03, comprising processing said silver halide photographic material with a roller-transport type automatic developer under the conditions that satisfy the following relationships:

$$50 \leqq l^{0.75} \times T \leqq 124$$

$$0.7 \leqq l \leqq 3.1$$

where l is the length in meters of delivery path in the developer, and T is the time in seconds taken for the silver halide photographic material to pass through the path.

This method is adapted for rapid processing of silver halide photographic materials and the silver image obtained has a desired color and will not experience any "sepia deterioration" during storage.

20 Claims, 1 Drawing Sheet

METHOD OF PROCESSING SILVER HALIDE PHOTOGRAPHIC MATERIAL WHICH PREVENTS SEPIA DETERIORATION

BACKGROUND OF THE INVENTION

The present invention relates to a method of processing silver halide photographic materials. More particularly, the present invention relates to a method that is adapted for rapid processing of silver halide photographic materials to produce a desired silver image color without yellowing and which is capable of preventing color change to sepia notwithstanding prolonged storage.

One of the requirements called for in the field of silver halide photographic materials is to achieve more rapid development, or to increase the amount of photographic materials that can be processed in unit time. This is also true with X-ray sensitive materials, for example, medical X-ray films because the recent rapid increase in the number of periodical physical checkups performed on the general public and the corresponding increase in the number of items to be checked in order to assure more exact diagnosis have caused the need for taking an increasing number of X-ray pictures.

A problem with the conventional techniques for rapid processing of X-ray sensitive and other black-and-white light-sensitive materials is that the resulting silver image color is sometimes tinged with yellow shades. Ideally, the silver image to be obtained should have a bright black color and yellowing is not desired for practical purposes. The problem described above is probably due to the smallness of silver grains obtained in rapid processing as compared with the case of normal processing. In any event, it has been difficult to attain a desired silver color by the prior art of rapid processing.

Rapid processing also involves a shorter fixing time but this often causes insufficient fixing on account of incomplete washout of unwanted silver and, as a consequence, the image obtained will experience so-called "sepia deterioration", or a change in color to sepia during storage. "Sepia deterioration" is generally undesired and should be avoided as much as possible in light-sensitive materials that are required to be stored for a long period (e.g., medical X-ray sensitive materials must be preserved for as many as 10 years in Japan).

Various attempts have been made to accomplish rapid processing without experiencing deterioration of silver color or "sepia deterioration" but it has been difficult to develop a technique that perfectly satisfies this requirement.

SUMMARY OF THE INVENTION

The present invention has been accomplished under the circumstances described above and the principal object of the invention is to provide a method of rapidly processing a silver halide photographic material that is capable of producing a silver image having a desired color which will not experience "sepia deterioration" during storage.

This object of the present invention can be attained by a method of processing a silver halide photographic material having a total silver amount of no more than 7.0 g/m$^2$ on a support and containing at least one of a dye having a maximum absorption wavelength between 520–560 nm and a dye having a maximum absorption wavelength between 570–700 nm in such an amount that the increase in transmission optical density of the unexposed area after processing is no more than 0.03, comprising processing said silver halide photographic material with a roller-transport type automatic developer under the conditions that satisfy the following relationships:

$$50 \leqq l^{0.75} \times T \leqq 124$$

$$0.7 \leqq l \leqq 3.1$$

where l is the length in meters of the delivery path in the developer, and T is the time in seconds taken for the silver halide photographic material to pass through the path.

DETAILED DESCRIPTION OF THE INVENTION

Figure 1:
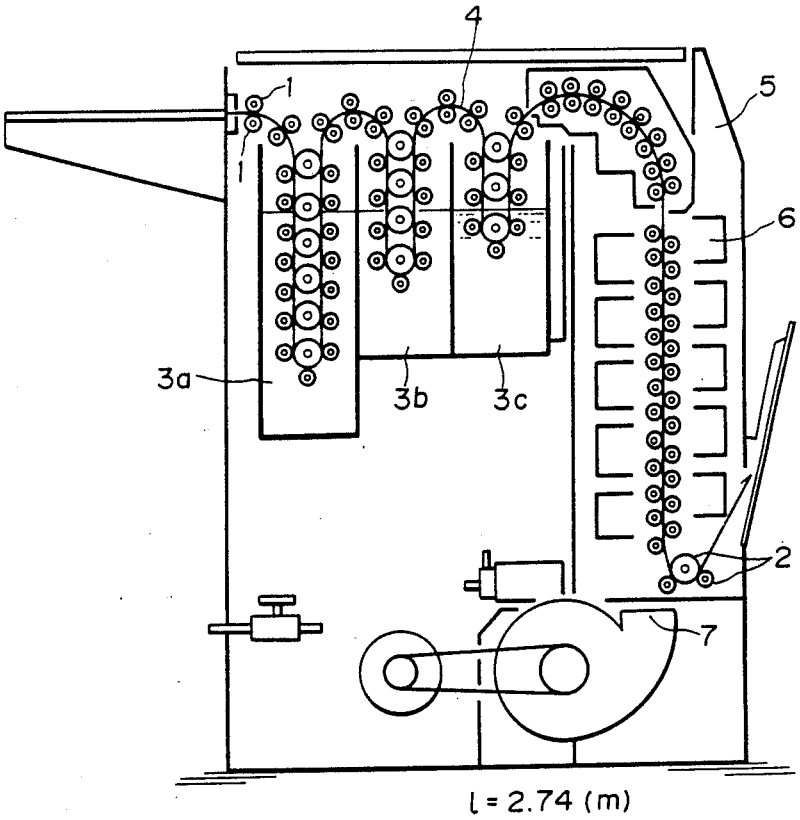
FIG. 1 is a schematic drawing of an exemplary automatic developing machine that can be used in the practice of the present invention.

In accordance with the present invention, a silver halide photographic material is processed under the specified conditions, the silver amount on this material is adjusted to be within the specified range and at least one of the dyes specified above is employed. By satisfying these particular requirements, the present invention is capable of preventing not only image yellowing but also insufficient fixing, as well as "sepia deterioration".

The present invention is described below in greater detail.

The silver halide photographic material to which the processing method of the present invention is to be applied has a silver amount of no more than 7.0 g/m$^2$, preferably of 2.0 to 7.0 g/m$^2$, for both sides of the support. The method of the present invention is applicable to either a one-side coated light-sensitive material having a light-sensitive layer on one side of the support or a two-side coated material having a light-sensitive layer on both sides of the support. Whichever type is used, the silver amount for both sides is calculated as the total amount; if a light-sensitive silver halide layer is formed on only one side of the support, the silver deposit on that side should be no more than 7.0 g/m$^2$; if a light-sensitive silver halide layer is formed on both sides of the support, the silver amount on both sides should not be more than 7.0 g/m$^2$. The silver amount is the amount of silver per square meter of a light-sensitive material.

Also, in the photographic material, silver is used in a weight ratio to gelatin within the range of preferably 0.57 to 3.50, more preferably 0.75 to 2.0.

The method of the present invention is adapted for rapid processing of silver halide photographic materials, and the advantages of the present invention are attained by operating a roller-transport type automatic developer under the conditions set forth above. Stated more specifically, the present invention is effective only when l and T satisfy the conditions set forth above; l (in meters) can be determined as the overall length of the processing line referenced to a light-sensitive material having photographic constituent layers on a polyethylene terephthalate support with a thickness of 175 μm; and T is the total time required for the leading edge of a film that is fed to the shaft of the first roller at the entrance of an automatic developer to pass through a developing tank, a connecting zone, a fixing tank, a connecting zone, a washing tank, a connecting zone and a drying zone and to emerge from the last roller at the exit end of the drying zone (in other words, T is the quotient (sec) obtained by dividing the overall length (m) of the processing line by the line transport speed (m/sec)). The reason for including the time associated with the connecting zones is that as is well known in the art, substantial processing can also be considered to take place in the connecting zones where the carryover from the previous step of processing is swelled in gelatin film.

An automatic developer that is preferably used in the method of the present invention is such that the length of the processing line, l, divided by the total number of transport rollers is within the range of 0.01–0.04. It is also preferred that the proportions of T occupied by the times during which the photographic material pass through the respective zones are as follows:

| | |
|---|---|
| Feeding - developing - connecting | 25–40% |
| fixing - connecting | 12–25% |
| washing - connecting | 10–25% |
| squeezing - drying | 25–45% |
| Total | 100% |

The rollers for use in the present invention preferably have a diameter of 12–60 mm and a length of 30–110 cm in the transport sections and may be made of various materials depending on the processing zone. For example, in the developing, fixing, washing and drying zones, the rollers may be based on bakelite (optionally containing glass powder, metal powder or plastic powder) or rubber (e.g., neoprene, isoprene, or silicone rubber). In the connecting and squeezing zones, the rollers are preferably made of silicone rubber that is water-repellent and elastic or "Kurarino" (trade name of Kuraray Co., Ltd.) which is a highly water-absorbent synthetic leather.

In order to attain the intended results in the present invention, l must be within the range of 0.7–3.1. If l is smaller than 0.7, not only the length of individual processing steps but also the number of rollers used is reduced, causing either low sensitivity or poor film transportability. If l is greater than 3.1, the transport speed becomes excessive and not only is the chance of abrasion damage to the film increased but also the durability of the automatic developer will rapidly deteriorate.

If the product of $l^{0.75}$ and T is less than 50, not only is the sensitivity of the film under processing reduced rapidly but also the problem of residual color can occur in films that use a sensitizing dye in an amount of no smaller than 10 mg/m$^2$ per side of the support. This problem was first revealed by the studies of the present inventors. Preferably, the product of $l^{0.75}$ and T is at least 76. If the product of $l^{0.75}$ and T exceeds 124, the granularity of photographic image will greatly deteriorate in spite of little increase in sensitivity and, at the same time, increased fog will occur.

In the practice of the present invention, the developing and fixing solutions for use in the automatic developer may contain various additives. Typical additives that can be incorporated in the developing solution include: anti-foggants; development accelerators made of alkalis such as sodium hydroxide, sodium carbonate and potassium carbonate; inorganic or organic restrainers such as potassium bromide, 2-methylbenzimidazole and methylbenzothiazole; water softeners such as polyphosphoric acid salts; and agents for preventing over-surface-development made of trace iodides and mercapto compounds. Other additives that can be incorporated as required include: preservatives such as sulfites; buffers (e.g., carbonates, boric acid, borates, and alkanolamines); alkali agents (e.g., hydroxides and carbonates); dissolving aids (e.g., polyethylene glycols and esters thereof); pH adjusting agents (e.g., organic acids such as acetic acid); sensitizers (e.g., quaternary ammonium salts); and surfactants.

A hardener can also be incorporated into the developing solution. Dialdehyde based hardeners are preferably used. The developing solution may further contain a chelating agent selected from among ethylene diaminetetraacetic acid, alkali metal salts thereof, polyphosphoric acid salts, nitriloacetic acid salts, etc.

The temperature for development is generally determined in connection with the processing time but is preferably in the range of 30°–40° C. for 6–20 seconds.

The fixing solution for use in the fixing step is typically an aqueous solution containing a thiosulfate and a water-soluble aluminum compound. It may contain a polybasic acid such as citric acid or tartaric acid. The pH of the fixing solution is desirably in the range of from about 3.5 to 5.0 at 20° C.

A stopping step may be incorporated after development in the method of the present invention. With roller-transport type automatic developers, the stopping step is usually omitted, so the developing solution is sometimes carried over into the fixing solution to increase the pH of the latter. Therefore, the pH of the fixing solution is desirably adjusted to be within the range of from about 3.6 to about 4.7 at 20° C.

Thiosulfates such as ammonium thiosulfate and sodium thiosulfate are commonly employed as fixing agents and ammonium thiosulfate is particularly preferred from the view point of fixing speed. The amount of fixing agents can be varied as appropriate and it is generally within the range of from about 0.1 to about 5 moles/L.

A water-soluble aluminum salt which chiefly acts as a hardener may be incorporated into the fixing solution. This is a compound generally known as a hardener for acidic hardening/fixing solutions and may be exemplified by aluminum chloride, aluminum sulfate and potassium alum. The fixing temperature and the time preferred for the purposes of the present invention may be within the respective ranges of 20°–35° C. and 4–15 seconds.

The developed and fixed photographic material is usually subjected to washing and drying steps. The purpose of washing is to remove substantially all of the silver salt that has been dissolved in the fixing step and it is preferably performed at ca. 20°–50° C. for 5–12 seconds. Drying is performed at ca. 40°–100° C. The drying time may be adjusted as appropriate in accordance with the ambient condition but is normally in the range of from about 5 to about 15 seconds.

A schematic drawing of an exemplary roller-transport type automatic developer that is preferably employed in the practice of the present invention is shown in FIG. 1, wherein 1 is the first roller at the end of the machine at which the photographic material is fed; 2 is the last roller at the exit end of the drying zone; 3*a* is a developing tank; 3*b* is a fixing tank; 3*c* is a washing tank; 4 is the light-sensitive material to be processed; 5 is a squeezing zone; 6 is the drying zone; and 7 is an inlet through which dry air is blown.

The silver halide photographic material to be processed by the method of the present invention contains at least one of a dye having a maximum absorption wavelength between 520 and 560 nm, preferably between 530 and 555 nm and a dye having a maximum absorption wavelength between 570 and 700 nm, preferably between 580 and 650 nm. Therefore, the silver halide photographic material to which the method of the present invention is to be applied may contain one or more dyes alone having a maximum absorption wavelength between 520 and 560 nm, or one or more dyes alone having a maximum absorption wavelength between 570 and 700 nm, or alternatively one or more dyes of each type. The term "maximum absorption wavelength" as used hereinabove refers to the value as measured for the case where the relevant dye or dyes are incorporated into the light-sensitive material.

The dye or dyes described above are incorporated into the light-sensitive material in such an amount that the transmission optical density of the unexposed area after development and subsequent treatments will increase by no more than 0.03 owing to the incorporation of these dyes. The amount defined above may be such that the color at an image density of 1.0 will be neutral black. An optimum amount of dyes to be added will depend on various factors including the density of support, extinction coefficient of dye, maximum absorption wavelength of dye and the color of developed silver. An optimum value for the proportions of two dyes having maximum absorption wavelengths of 520–560 nm and 570–700 nm will also vary but the preferred amount of each dye in the silver halide photographic material ranges from $1\times10^{-7}$ to $1\times10^{-4}$ moles/m$^2$. A more preferred range is from $2\times10^{-7}$ to $2\times10^{-5}$ moles/m$^2$, with the range of $5\times10^{-7}$ to $1.5\times10^{-5}$ moles/m$^2$ being the most preferred.

The dye or dyes described may be incorporated into any photographic constituent layer such as a silver halide emulsion layer, a protective layer, a backing layer, an antihalation layer, or an intermediate layer. The dyes may be incorporated into two or more layers. Preferably, they are incorporated into a silver halide emulsion layer and/or a backing layer.

Any dyes having the maximum absorption wavelengths set forth above may be employed in the present invention. For example, suitable dyes may be selected from among common azo dyes, anthraquinone dyes, azomethine dyes, indoaniline dyes, oxonole dyes, carbocyanine dyes, triphenylmethane dyes, styryl dyes, etc. that have the desired maximum absorption wavelengths. Because of small effects on stability to development and other aspects of photographic performance, suitable dyes are preferably selected from among anthraquinone dyes, azo dyes, azomethine dyes, oxonole dyes, styryl dyes and indoaniline dyes. Examples of the azomethine dye include those having the following formula (I) and examples of the indoaniline dye include those having the following formula (II):

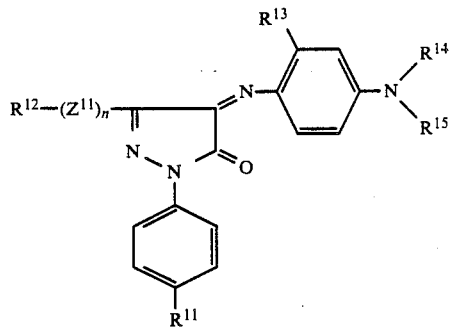

(I)

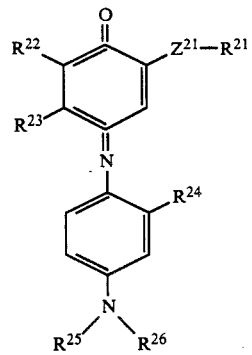

(II)

where $R^{11}$, $R^{12}$ and $R^{21}$ which may be the same or different each represents an aryl, alkyl or heterocyclic group (each being optionally substituted); $R^{13}$ and $R^{24}$ which may be the same or different each represents a hydrogen atom, a halogen atom, an alkyl group or an alkoxy group; $R^{14}$, $R^{15}$, $R^{25}$ and $R^{26}$ which may be the same or different each represents an alkyl (which is optionally substituted) group ($R^{14}$ and $R^{15}$ or $R^{25}$ and $R^{26}$ may combine together to form a ring); $R^{22}$ is a hydrogen atom, an alkyl group or a halogen atom; $R^{23}$ is a hydrogen atom, an alkyl group or an acylamino group ($R^{22}$ and $R^{23}$ may combine together to form a ring, and each of these groups is optionally substituted); $Z^{11}$ is —NHCO—, —NH—, —NHCONH—, —COO— or —O—; $Z^{21}$is —CONH—, —NHCO— or —NHCONH—; and n is 0 or 1.

The alkyl group represented by $R^{11}$, $R^{12}$ or $R^{21}$is preferably a straight- or branched-chain alkyl group having 1–20 carbon atoms and it may have a substituent such as a halogen atom, an alkoxy group, an aryloxy group, an alkoxycarbonyl group, an aryloxycarbonyl group, a hydroxyl group, an acylamino group, a carbamoyl group, a sulfamoyl group or a cyano group.

The aryl group represented by $R^{11}$, $R^{12}$ or $R^{21}$ may be exemplified by a phenyl or an $\alpha$- or $\beta$-naphthyl group, and it may have one or more substituents selected from among an alkyl group, an alkoxy group, an aryloxy group, a halogen atom, an alkoxycarbonyl group, an acylamino group, a carbamoyl group, an alkylcarbamoyl group, an arylcarbamoyl group, an alkylsulfonamido group, an arylsufonamido group, a sulfamoyl group, an alkylsulfamoyl group, a cyano group, a nitro group, etc.

The heterocyclic group represented by $R^{11}$, $R^{12}$ or $R^{21}$may be exemplified by a pyridyl group, a quinolyl group, a furyl group, a benzothiazolyl group, an oxyazolyl group, or an imidazolyl group. It may have a substituent selected from among those which are enumerated for the aryl group.

A preferred example of $R^{11}$ is a phenyl group which is substituted in at least one ortho-position with an alkyl group, a halogen atom, an alkoxy group, etc.

The alkyl group represented by $R^{13}$ or $R^{24}$ is preferably an alkyl group having 1–20 carbon atoms which is the same as the one defined for $R^{11}$, $R^{12}$ or $R^{21}$.

The alkyl group represented by $R^{22}$ or $R^{23}$ is preferably an alkyl group having 1–3 carbon atoms as exemplified by methyl, ethyl or propyl. A preferred example of the ring that is formed by $R^{22}$ and $R^{23}$ taken together is a benzene ring. A preferred example of the halogen atom represented by $R^{22}$ is a chlorine atom. A preferred example of the acylamino group represented by $R^{23}$ is one having 10–30 carbon atoms which is substituted by an alkoxy or aryloxy group (which may be substituted by an alkyl group, etc.).

The alkyl group represented by $R^{14}$, $R^{15}$, $R^{25}$ or $R^{26}$ is preferably one having 1–6 carbon atoms (e.g., methyl, ethyl, n-butyl, iso-propyl or n-hexyl), and particularly preferred are substituted alkyl groups having a total carbon number of 2–10 (exemplary substituents include hydroxyl, sulfonamido, sulfamoyl, alkoxy, halogen, acylamino, carbamoyl, ester and cyano). Examples of the ring that is formed by $R^{14}$ and $R^{15}$ or $R^{25}$ and $R^{26}$ taken together include a piperidine ring, a pyrrolidine ring and a morpholine ring.

The dyes represented by the formulas (I) and (II) have maximum absorption wavelengths preferred for the purposes of the present invention. The dyes of the formula (I) assume a magenta color, and the dyes of the formula (II) assume a purple to cyan color. These dyes have high extinction coefficients and need to be incorporated in small enough amounts to minimize the effects that would otherwise be exerted upon photographic performance due to dye loading. Furthermore, these dyes will not experience any washout, discoloration or change in color as a result of development, fixing or washing. In addition, they will undergo a very small amount of fading upon exposure to light. These advantages of the dyes are particularly noticeable when the finished photographic material is subjected to prolonged exposure to a high-luminance X-ray film lantern slide.

Specific examples of the dyes that can be used in the present invention are listed below. It should, of course, be understood that these are not the only examples of suitable dyes.

(1)

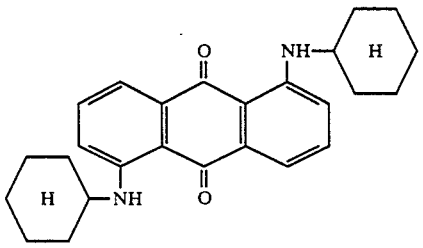

(2)

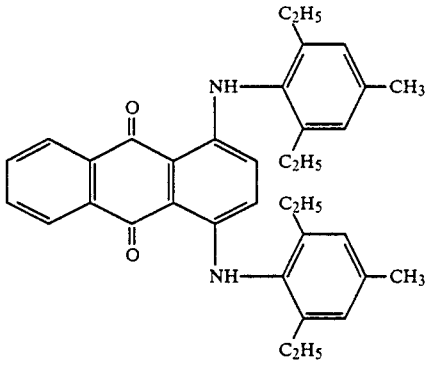

(3)

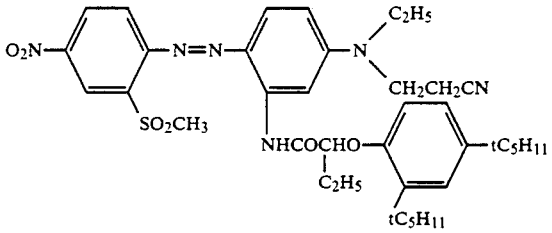

(4)

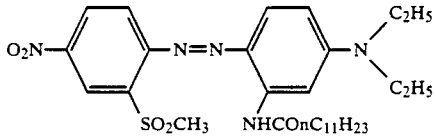

-continued
(5)
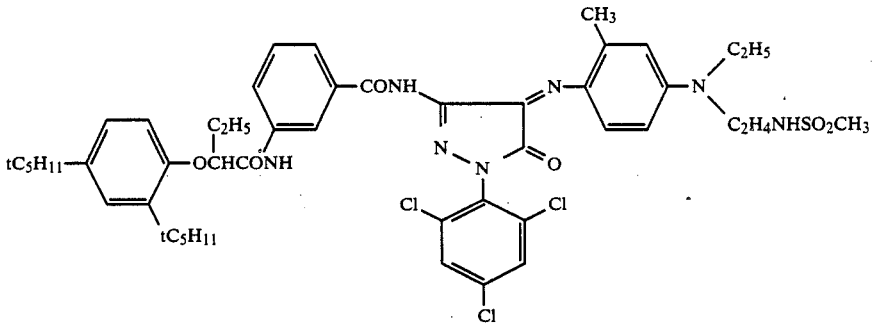
(6)
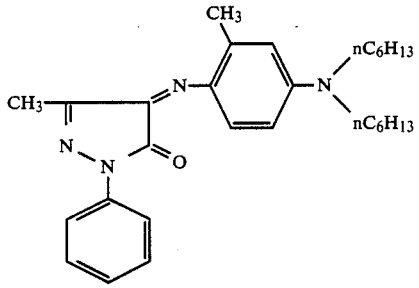
(7)
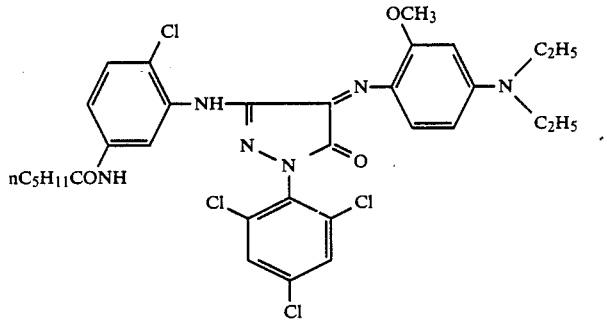
(8)
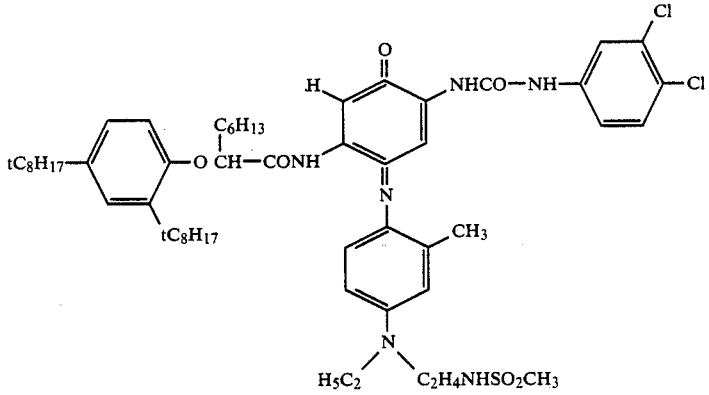

-continued (9)

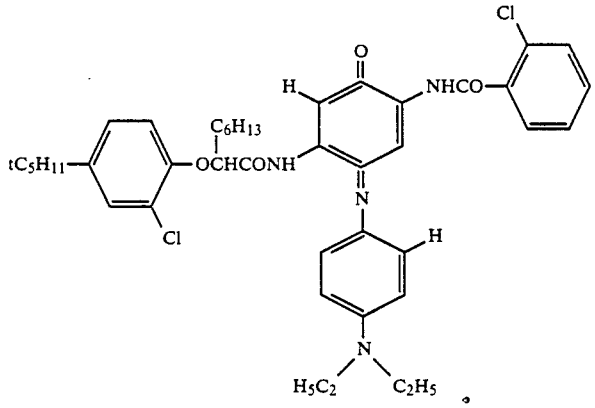

(10)

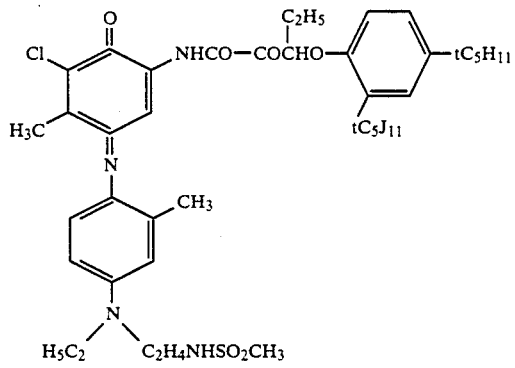

(11)

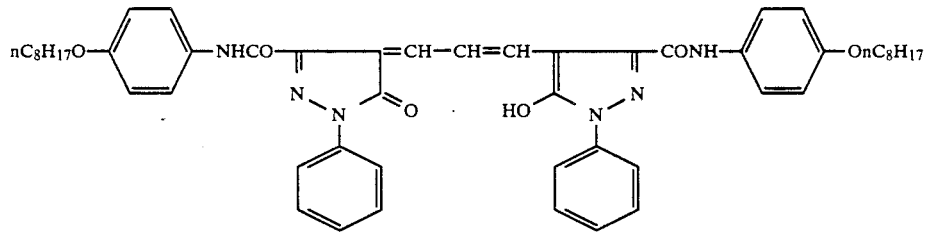

(12)

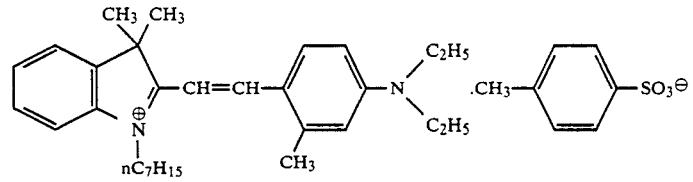

The compounds listed above can be synthesized by known methods.

The dyes for use in the present invention may be dispersed in silver halide emulsion layers or other hydrophilic colloidal layers (e.g., intermediate layers, protective layer, anti-halation layer, and filter layer) by various known methods. In one method, the dyes are directly dissolved or dispersed in silver halide emulsion layers or other hydrophilic colloidal layers. In another method, the dyes are dissolved or dispersed in aqueous solutions or solvents (e.g., methanol and other organic solvents) and are thereafter incorporated into silver halide emulsion layers or other hydrophilic colloidal layers. Alternatively, the dyes may be dissolved in oils, or high-boiling point (≦160° C.) that are substantially water-insoluble or organic solvents boiling at 30°-150° C., and the resulting solutions are dispersed in hydrophilic colloidal solutions. According to still another method, the dyes and necessary additives may be incorporated into photographic emulsion layers or other hydrophilic colloidal layers together with polymer latices. If desired, hydrophilic polymers having charges of opposite polarity to dye ions may be incorporated as mordants into relevant layers, so that the dyes are localized in specific layers by the interaction between the dye molecules and the polymers.

The following example is provided for the purpose of further illustrating the present invention but is in no way to be taken as limiting.

EXAMPLE 1

Silver iodobromide containing 30 mol % of silver iodide was grown at pH of 9.3 and pAg of 7.5 on nuclei which were monodispersed grains of silver iodobromide with an average grain size of 0.2 μm that contained 2.0 mol % of silver iodide. Thereafter, equal moles of potassium bromide and silver nitrate were added at pH of 7.8 and pAg of 8.9 to prepare three types of monodispersed emulsion particles having average sizes of 0.98 μm, 0.60 μm and 0.51 μm that were silver iodobromide grains containing 2.3 moles of silver iodide on average. Excess salts were removed from each emulsion by a standard floculation method, in which the condensation product of sodium naphthalenesulfonate and formaldehyde and an aqueous solution of magnesium sulfate were added to form a precipitate while maintaining the temperature at 40° C.; after removing the supernatant, pure water with a temperature of up to 40° C. was added and an aqueous solution of magnesium sulfate was further added to form a precipitate, followed by removal of the supernatant. Each of the desalted emulsions was chemically ripened by adding $1.9\times10^{-3}$ moles of ammonium thiocyanate per mole of silver, suitable amounts of chloroauric acid and hypo, and a total of 800 mg, per mole of silver halide, of spectral sensitizing dyes A and B (25:1 in weight ratio) having the structures shown below. Fifteen minutes before completion of the chemical ripening, 200 mg of potassium iodide was added per mole of silver. Thereafter, the three emulsions were stabilized with $3\times10^{-2}$ moles of 4-hydroxy-6-methyl-1,3,3*a*,7-tetrazaindene and mixed together in proportions of 15%, 45% and 40% in the decreasing order of grain size. To the mixture, additives (for their names, see below) and lime-treated gelatin were added.

SPECTRAL SENSITIZING DYE A

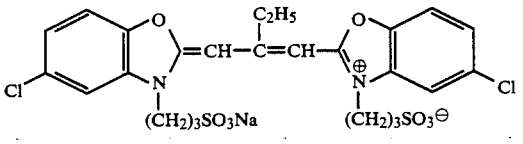

SPECTRAL SENSITIZING DYE B

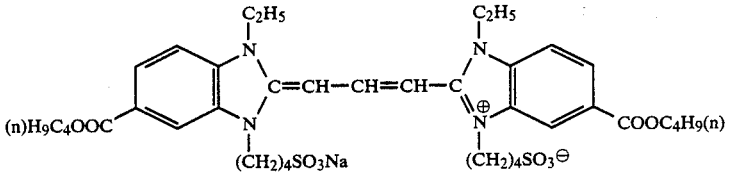

The dyes shown in Table 1 to be given below were dissolved in an oil made of tricresyl phosphate and the solutions were dispersed in a hydrophilic colloidal solution. The resulting dispersions were added to the emulsion mixture in the amounts also, shown in Table 1 so that they would be incorporated into silver halide emulsion layers in light-sensitive materials. The following are the additives used in silver halide emulsion coating solutions. The amounts of their addition are indicated in terms of the value for one mole of silver halide.

| | |
|---|---|
| 1,1-Dimethylol-1-bromo-1-nitromethane | 65 mg |

-continued

| | |
|---|---|
| 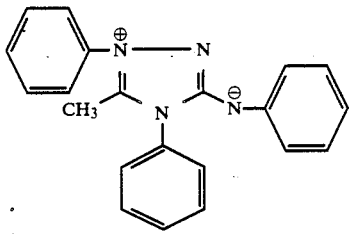 | 160 mg |
| t-Butyl-catechol | 350 mg |
| Polyvinylpyrrolidone (m.w. 10,000) | 1.0 g |
| Styrene-maleic anhydride copolymer | 2.5 g |
| Trimethylolpropane | 12 g |
| Diethylene glycol | 6 g |
| Nitrophenyl-triphenyl phosphonium chloride | 30 mg |
| Ammonium 1,3-hydroxybenzene-4-sulfonate | 3.5 g |
| Sodium 2-mercaptobenzimidazole-5-sulfonate | 1.5 mg |
| 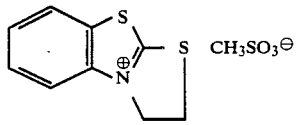 | 60 mg |
| 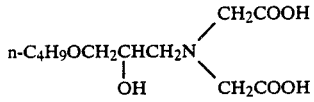 | 0.9 g |

A protective layer was formed from a coating solution having the following composition. The amounts of individual components are indicated in terms of a value per liter of the coating solution.

| | |
|---|---|
| Lime-treated inert gelatin | 68 g |
| Acid-treated gelatin | 2 g |
| 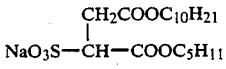 | 1.1 g |
| (coating aid) | |
| Polymethyl methacrylate (matting agent with an area average particle size of 5.0 μm) | 1.0 g |
| Silicon dioxide particles (matting agent with an area average particle size of 1.2 μm) | 0.35 g |
| Colloidal silica ("Rudox AM" of Du Pont) | 40 g |
| 2% Aqueous solution of 2,4-dichloro-6-hydroxy-1,3,5-triazine sodium salt (hardener) | 12 ml |
| 35% Aqueous solution of formaldehyde (hardener) | 3 ml |
| 40% Aqueous solution of glyoxal (hardener) | 1.0 ml |
| 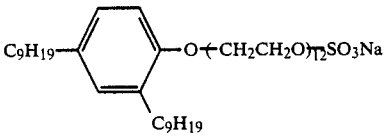 | 1.0 g |

-continued

| | |
|---|---|
| 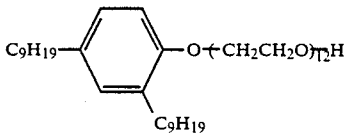 | 0.4 g |
| $CH_2COO(CH_2)_9CH_3$<br>\|<br>$CHCOO(CH_2)_2CH(CH_3)_2$<br>\|<br>$SO_3Na$ | 0.3 g |
| 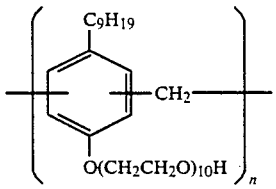 <br>(mixture of n = 2 to n = 5) | 2.0 g |
| $NaO_3S-CH(CH_2COOCH_2(C_2F_4)_3H)-COOCH_2(C_2F_4)_3H$ | 0.5 g |
| $F_{19}C_9-O(CH_2CH_2O)_{10}CH_2CH_2-OH$ | 5 mg |
| $C_4F_9SO_3K$ | 2 mg |

Polyethylene terephthalate film bases having a thickness of 175 μm were coated with a subbing layer formed from an aqueous dispersion of a copolymer (50 wt % glycidyl methacrylate, 10 wt % methyl acrylate and 40 wt % butyl methacrylate) that had been diluted to a concentration of 10 wt %. To both sides of each film base, an emulsion layer and a protective layer were simultaneously applied with two units of slide hopper coater at a speed of 65 m per minute in coating amounts that were respectively 2.0 g/m$^2$ (as hydrophilic colloid) and 1.0 g/m$^2$ (as gelatin amount). The applied layers were dried for 2 minutes and 20 seconds to prepare sample Nos. 1–16 (the silver amount in each sample was adjusted as shown in Table 1).

All of the samples thus prepared had a melting point of at least 95° C. with respect to water.

The sensitivity of each sample was measured by the following procedures: the sample sandwiched between two fluorescent intensifying screens ("KO-250" sold by Konica Corp.) was irradiated with X-rays for 0.06 seconds at a tube voltage of 110 kVP and at 50 mA to effect exposure through a penetrameter type B (aluminum stage; sold by Konica Medical Co., Ltd.) and thereafter processed with an automatic developing machine (see FIG. 1) and the agents described below (developing and fixing solutions).

DEVELOPING SOLUTION

| Developing solution | |
|---|---|
| Potassium sulfite | 70 g |
| Hydroxyethyl ethylenediaminetriacetic acid trisodium salt | 8 g |

-continued

| Developing solution | |
|---|---|
| 1,4-Dihydroxybenzene | 28 g |
| Boric acid | 10 g |
| 5-Methylbenzotriazole | 0.04 g |
| 1-Phenyl-5-mercaptotetrazole | 0.01 g |
| Sodium metabisulfite | 5 g |
| Acetic acid (90%) | 13 g |
| Triethylene glycol | 15 g |
| 1-Phenyl-3-pyrazolidone | 1.2 g |
| S-Nitroindazole | 0.2 g |
| 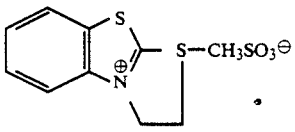 | 0.001 g |
| Glutaraldehyde | 4.0 g |
| Ethylenediaminetetraacetic acid disodium salt | 2.0 g |
| Potassium bromide | 4.0 g |
| 5-Nitrobenzimidazle | 1.0 g |
| Water | to make 1,000 ml |
| pH | adjusted to 10.50 with potassium hydroxide |

FIXING SOLUTION

| Fixing solution | |
|---|---|
| Sodium thiosulfate ($5H_2O$) | 45 g |
| Ethylenediaminetetraacetic acid disodium | 0.5 g |
| Ammonium thiosulfate | 150 g |
| Anhydrous sodium sulfite | 8 g |
| Potassium acetate | 16 g |
| Aluminum sulfate (10–18 $H_2O$) | 27 g |
| Sulfuric acid (50 wt %) | 6 g |
| Citric acid | 1 g |
| Boric acid | 7 g |
| Glacial acetic acid | 5 g |
| Water to make | 1,000 ml |
| pH adjusted to 4.0 with glacial acetic acid | |

The relative sensitivity of each sample was calculated by determining the amount of exposure that provided base density + fog density + 1.0 on the characteristic curves obtained. The results are shown in Table 1.

Two specimens of each sample were provided and one of them was developed and subsequently processed under the same conditions as those described above after it was given uniform exposure until a darkened density of 1.2 was attained. The other specimen was processed without exposure. The color of silver image produced on the specimen processed after exposure was observed and the results are shown in Table 1. The same specimen was divided into two portions, one of which was left to stand for 1 day at 65° C. and at a relative humidity of 70%. The degree of deterioration of silver image color (the degree of "sepia deterioration") in this portion was compared with that in the other portion. The results were evaluated on a 5-point rating system and are shown in Table 1; 5 (excellent) - 3: acceptable for practical purposes; 1 (poor) - 2: unacceptable.

The specimens that were processed without exposure were subjected to transmission density measurement with visual light and the difference in density (ΔD) from the samples not loaded with dyes is shown in Table 1.

TABLE 1

| Sample No. | Dye type | Dye amount (mol/m² on both sides) | Dye λ max | Silver amount (g/m² on both sides) | $l^{0.75} \times T$ (m.sec) | Sensitivity | ΔD | Silver image color *1 | Sepia deterioration | Remarks *2 |
|---|---|---|---|---|---|---|---|---|---|---|
| 1 | — | — | — | 7.5 | 105 | 130 | 0 | C | 1 | X |
| 2 | 12 | $2.5 \times 10^{-6}$ | 534 | 7.5 | 105 | 125 | 0.015 | A | 1 | X |
| | 9 | $7.5 \times 10^{-6}$ | 620 | | | | | | | |
| 3 | — | — | — | 6.0 | 105 | 115 | 0 | B | 2 | X |
| 4 | 12 | $2.5 \times 10^{-6}$ | 534 | 6.0 | 105 | 100 | 0.015 | A | 3 | O |
| | 9 | $7.5 \times 10^{-6}$ | 620 | | | | | | | |
| 5 | — | — | — | 5.0 | 105 | 100 | 0 | B | 3 | X |
| 6 | 12 | $2.5 \times 10^{-6}$ | 534 | 5.0 | 105 | 95 | 0.015 | A | 4 | O |
| | 9 | $7.5 \times 10^{-6}$ | 620 | | | | | | | |
| 7 | 5 | $1.5 \times 10^{-6}$ | 550 | 5.0 | 105 | 97 | 0.02 | A | 4 | O |
| | 10 | $9.0 \times 10^{-6}$ | 655 | | | | | | | |
| 8 | 5 | $1.5 \times 10^{-6}$ | 550 | 4.5 | 105 | 95 | 0.02 | A | 5 | O |
| | 10 | $9.0 \times 10^{-6}$ | 655 | | | | | | | |
| 9 | 10 | $8.0 \times 10^{-6}$ | 655 | 4.5 | 105 | 98 | 0.015 | A | 5 | O |
| | 12 | $1.0 \times 10^{-6}$ | 534 | | | | | | | |
| 10 | — | — | — | 5.0 | 84.3 | 93 | 0 | B | 2 | X |
| 11 | 10 | $8.0 \times 10^{-6}$ | 655 | 5.0 | 84.3 | 90 | 0.02 | A | 3 | O |
| | 12 | $1.0 \times 10^{-6}$ | 534 | | | | | | | |
| 12 | 10 | $9.0 \times 10^{-6}$ | 655 | 5.0 | 84.3 | 90 | 0.02 | A | 3 | O |
| | 5 | $1.5 \times 10^{-6}$ | 550 | | | | | | | |
| 13 | 12 | $2.5 \times 10^{-6}$ | 534 | 5.0 | 84.3 | 90 | 0.02 | A | 4 | O |
| | 9 | $7.5 \times 10^{-6}$ | 620 | | | | | | | |
| 14 | 11 | $2.0 \times 10^{-6}$ | 540 | 5.0 | 84.3 | 90 | 0.02 | A | 4 | O |
| | 10 | $8.0 \times 10^{-6}$ | 655 | | | | | | | |
| 15 | 11 | $2.0 \times 10^{-6}$ | 540 | 4.5 | 84.3 | 88 | 0.02 | A | 5 | O |
| | 10 | $8.0 \times 10^{-6}$ | 655 | | | | | | | |
| 16 | 12 | $2.5 \times 10^{-6}$ | 534 | 4.5 | 84.3 | 88 | 0.02 | A | 5 | O |
| | 9 | $7.5 \times 10^{-6}$ | 620 | | | | | | | |

*1 A: neutral black
B: somewhat yellowish black
C: yellowish black
*2 O: sample of the present invention
X: comparative sample As is clear from Table 1, in accordance with the present invention, very rapid processing of silver halide photographic materials could be accomplished, with the silver image obtained maintaining a neutral black color. The decrease in sensitivity due to the incorporation of dyes was negligible, with the added advantage of reduced "sepia deterioration".

Therefore, the method of the present invention is adapted for rapid processing of silver halide photographic materials and the silver image obtained has a desired color and will not experience any substantial "sepia deterioration" during storage.

What is claimed is:

1. A method of processing a silver halide photographic material having a total silver amount of no more than 7.0 g/m² on a support and containing at least one of a dye having a maximum absorption wavelength between 520–560 nm and a dye having a maximum absorption wavelength, between 570–700 nm in an amount effective to increase the transmission optical density of the unexposed area after processing by no more than 0.03,comprising the step of processing said silver halide photographic material with a roller-transport type automatic developer under the conditions that satisfy the following relationships:

$$50 \leqq l^{0.75} \times T \leqq 124$$

$$0.7 \leqq l \leqq 3.1$$

wherein l is the length in meters of the delivery path in the developer, and T is the time in seconds taken for the silver halide photographic material to pass through the path.

2. A method according to claim 1 wherein said silver halide photographic material has a light-sensitive layer on both sides of the support.

3. A method according to claim 1 wherein said silver halide photographic material has a light-sensitive layer on one side of the support.

4. A method according to claim 1 wherein said silver halide photographic material contains at least one of a dye having a maximum absorption wavelength between 530 and 555 nm and a dye having a maximum absorption wavelength between 570 and 700 nm.

5. A method according to claim 1 wherein said silver halide photographic material contains at least one of a dye having a maximum absorption wavelength between 520 and 560 nm and a dye having a maximum absorption wavelength between 580 and 650 nm.

6. A method according to claim 1 wherein at least one of said dyes is incorporated into said silver halide photographic material in such an amount that the color at an image density of 1.0 will be neutral black.

7. A method according to claim 1 wherein said dye having a maximum absorption wavelength between 520 and 560 nm is incorporated into said silver halide photographic material in an amount ranging from $1 \times 10^{-7}$ to $1 \times 10^{-4}$ moles/m².

8. A method according to claim 1 wherein said dye having a maximum absorption wavelength between 570 and 700 nm is incorporated into said silver halide photographic material in an amount ranging from $1 \times 10^{-7}$ to $1 \times 10^{-4}$ moles/m².

9. A method according to claim 1 wherein said dyes are selected from the group consisting of anthraquinone dyes, azo dyes, azomethine dyes, oxonole dyes, styryl dyes and indoaniline dyes.

10. A method according to claim 9 wherein said dye is an azomethine dye represented by the formula (I):

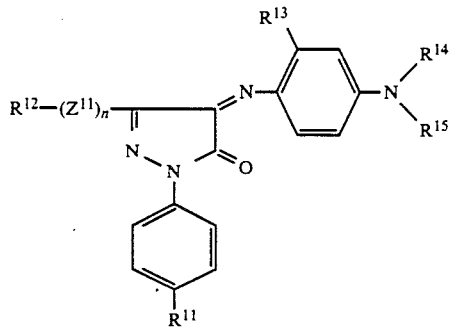

(I)

wherein $R^{11}$ and $R^{12}$ each represents an aryl, alkyl or heterocyclic group; $R^{13}$ represents a hydrogen atom, a halogen atom, an alkyl group or an alkoxy group; $R^{14}$ and $R^{15}$ each represents an alkyl; $Z^{11}$ is —NHCO—, —NH—, —NHCONH—, —COO— or —O— and n is 0 or 1.

11. A method according to claim 9 wherein said dye is an indoaniline dye represented by the formula (II):

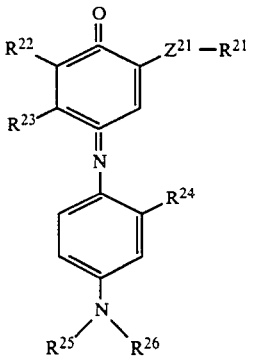

(II)

wherein $R^{21}$represents an aryl, alkyl or heterocyclic group; $R^{22}$ is a hydrogen atom, an alkyl group or a halogen atom; $R^{23}$ is a hydrogen atom, an alkyl group or an acylamino group; $R^{24}$ represents a hydrogen atom, a halogen atom, an alkyl group or an alkoxy group; $R^{25}$ and $R^{26}$ each represents an alkyl and $Z^{21}$is —CONH—, —NHCO— or —NHCONH—.

12. A method according to claim 1 wherein at least one of said dyes is incorporated into a silver halide emulsion layer, a backing layer or both.

13. A method according to claim 1 wherein said silver halide photographic material is processed under the conditions that satisfy the following relationships:

$$76 \leqq l^{0.75} \times T \leqq 124$$

$$0.7 \leqq l \leqq 3.1.$$

14. A method according to claim 1 wherein said roller-transport type automatic developer is such that the value of l divided by the total number of transport rollers is within the range of 0.01–0.04.

15. A method according to claim 1 wherein the proportions of T occupied by the times during which the photographic material passes through the respective zones are as follows:

| | |
|---|---|
| Feeding-developing-connecting | 25–40% |
| fixing-connecting | 12–25% |
| washing-connecting | 10–25% |
| squeezing-drying | 25–45% |
| Total | 100% |

| | |
|---|---|
| Feeding - developing - connecting | 25–40% |
| fixing - connecting | 12–25% |
| washing - connecting | 10–25% |
| squeezing - drying | 25–45% |
| Total | 100% |

16. A method according to claim 1 wherein a developing step is performed at 30°–40° C. for 6–20 seconds.

17. A method according to claim 1 wherein a fixing step is performed at 20°–35° C. for 4–15 seconds.

18. A method according to claim 1 wherein a washing step is performed at 20°–50° C. for 5–12 seconds.

19. A method according to claim 1 wherein a drying step is performed at 40°–100° C. for 5–15 seconds.

20. A method according to claim 1 wherein said processing step employs a fixing solution having a pH of 3.5–5.0 at 20° C.

* * * * *

UNITED STATES PATENT AND TRADEMARK OFFICE

CERTIFICATE OF CORRECTION

PATENT NO. : 4,940,652

DATED : July 10, 1990

INVENTOR(S) : Satoru Nagasaki

It is certified that error appears in the above-identified patent and that said Letters Patent is hereby corrected as shown below:

Claim 11, column 19, line 42, "$R^{21}$" should be followed by a space.

Claim 15, column 20, lines 30-34 should be deleted.

At the following places in the patent, the symbol "1" should be the the symbol --2--, which is the symbol used by the PTO at all other occurrences in the patent:

In the Abstract, lines 14, 15 and 16, (first occurrences);

Column 2, line 10;

Column 2, line 58 (first and second occurrences);

Column 3, line 11;

Column 3, line 37 (first and second occurrences);

Column 3, line 41 (first occurrence);

Column 3, line 45;

UNITED STATES PATENT AND TRADEMARK OFFICE

CERTIFICATE OF CORRECTION

PATENT NO. : 4,940,652

DATED : July 10, 1990

INVENTOR(S) : Satoru Nagasaki

It is certified that error appears in the above-identified patent and that said Letters Patent is hereby corrected as shown below:

Column 3, line 51;

Column 3, line 52;

Column 17, claim 1, line 65; and

Column 20, claim 14, line 14.

Signed and Sealed this

Fifth Day of May, 1992

*Attest:*

DOUGLAS B. COMER

*Attesting Officer*

*Acting Commissioner of Patents and Trademarks*